US010362871B2

(12) United States Patent
Boekhoff et al.

(10) Patent No.: US 10,362,871 B2
(45) Date of Patent: Jul. 30, 2019

(54) DEVICE AND METHOD FOR FIXING A PUSH ELEMENT

(71) Applicant: Paul Hettich GmbH & Co. KG, Kirchlengern (DE)

(72) Inventors: Heiko Boekhoff, Bad Oeynhausen (DE); Andreas Stuffel, Bueckeburg (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 0 days.

(21) Appl. No.: 15/569,169

(22) PCT Filed: May 3, 2016

(86) PCT No.: PCT/EP2016/059890

§ 371 (c)(1),
(2) Date: Oct. 25, 2017

(87) PCT Pub. No.: WO2016/177732

PCT Pub. Date: Nov. 10, 2016

(65) Prior Publication Data

US 2018/0146782 A1 May 31, 2018

(30) Foreign Application Priority Data

May 4, 2015 (DE) ..... 10 2015 106 852

(51) Int. Cl.
*A47B 88/427* (2017.01)
*A47B 88/407* (2017.01)

(52) U.S. Cl.
CPC ..... *A47B 88/427* (2017.01); *A47B 88/407* (2017.01); *A47B 2088/4272* (2017.01);
(Continued)

(58) Field of Classification Search
CPC ..... A47B 88/427; A47B 88/403; A47B 96/06; A47B 88/407; A47B 88/40; A47B 88/423
(Continued)

(56) References Cited

U.S. PATENT DOCUMENTS 5,588,729 A * 12/1996 Berger ..... A47B 88/427 312/330.1
5,737,820 A 4/1998 Ferrari et al.
(Continued)

FOREIGN PATENT DOCUMENTS

AT 506879 * 12/2009
AT 508 544 A4 2/2011
(Continued)

OTHER PUBLICATIONS

International Search Report of PCT/EP2016/059888, dated Jul. 26, 2016.
(Continued)

*Primary Examiner* — Janet M Wilkens
(74) *Attorney, Agent, or Firm* — Collard & Roe, P.C.

(57) ABSTRACT

A device for fixing a push element, in particular a drawer box to a rail of a pull-out guide, the device comprising a clamping mechanism with a receptacle for a holding part and a device for depth adjustment for the drawer box, wherein the device for depth adjustment comprises a stop that can be adjusted either on or in the receptacle. As a result, a precise orientation of the drawer box to a pull-out guide can be achieved using simple means.

17 Claims, 10 Drawing Sheets

(52) U.S. Cl.
CPC ..... *A47B 2088/4274* (2017.01); *A47B 2088/4276* (2017.01); *A47B 2088/4278* (2017.01); *A47B 2210/0056* (2013.01); *A47B 2230/0014* (2013.01)

(58) Field of Classification Search
USPC ..... 312/334.7, 223.1, 334.4, 334.5, 348.1, 312/348.2, 334.6, 333; 384/22
See application file for complete search history.

(56) References Cited

U.S. PATENT DOCUMENTS

| | | | | |
|---|---|---|---|---|
| 6,913,334 | B2 | 7/2005 | Weichelt | |
| 8,056,994 | B2 * | 11/2011 | Chen | A47B 88/427 312/334.14 |
| 8,424,984 | B2 | 4/2013 | Ritter | |
| 8,727,460 | B2 | 5/2014 | Grabher | |
| 8,764,136 | B2 * | 7/2014 | Grabherr | A47B 88/427 312/334.27 |
| 8,854,769 | B1 * | 10/2014 | Liang | A47B 88/427 360/125.51 |
| 9,066,587 | B1 * | 6/2015 | Liang | A47B 88/0422 |
| 9,259,087 | B1 * | 2/2016 | Hsiao | A47B 88/0055 |
| 9,808,083 | B2 * | 11/2017 | Lucas | A47B 88/427 |
| 9,986,829 | B2 * | 6/2018 | McGregor | A47B 88/427 |
| 2003/0234603 | A1 * | 12/2003 | Salice | A47B 88/407 312/334.5 |
| 2004/0095047 | A1 * | 5/2004 | Salice | A47B 88/427 312/332.1 |
| 2004/0227440 | A1 * | 11/2004 | Booker | F16F 9/0218 312/334.1 |
| 2008/0218045 | A1 * | 9/2008 | Moser | A47B 88/427 312/333 |
| 2013/0113356 | A1 * | 5/2013 | Salice | A47B 88/0422 312/334.44 |
| 2013/0257244 | A1 * | 10/2013 | Salice | A47B 88/0418 312/319.1 |
| 2014/0015390 | A1 * | 1/2014 | Grabherr | A47B 88/04 312/334.4 |
| 2014/0175965 | A1 * | 6/2014 | Salice | A47B 88/04 312/334.1 |
| 2014/0210330 | A1 * | 7/2014 | Amann | A47B 88/0422 312/334.1 |
| 2014/0314347 | A1 | 10/2014 | Huang | |
| 2015/0147008 | A1 * | 5/2015 | McGregor | A47B 88/0422 384/22 |
| 2016/0025124 | A1 * | 1/2016 | Roedder | F16B 12/04 403/14 |
| 2016/0128476 | A1 * | 5/2016 | Ng | A47B 88/16 312/333 |
| 2017/0105525 | A1 | 4/2017 | Klaus | |
| 2017/0347794 | A1 * | 12/2017 | McGregor | A47B 88/49 |
| 2018/0140095 | A1 * | 5/2018 | Stuffel | A47B 88/427 |
| 2018/0146782 | A1 * | 5/2018 | Boekhoff | A47B 88/427 |
| 2018/0146783 | A1 * | 5/2018 | Stuffel | A47B 88/427 |

FOREIGN PATENT DOCUMENTS

| | | | |
|---|---|---|---|
| AT | 510714 | * | 6/2012 |
| AT | 512748 | * | 10/2013 |
| AT | 518136 | * | 7/2017 |
| DE | 4301327 | * | 8/1993 |
| DE | 696 14 443 | T2 | 5/2002 |
| DE | 20 2004 001 791 | U1 | 5/2004 |
| DE | 20 2009 017 319 | U1 | 5/2011 |
| DE | 202009013706 | * | 5/2011 |
| DE | 20 2010 007 765 | U1 | 11/2011 |
| DE | 202011004588 | * | 7/2012 |
| DE | 10 2011 000 724 | A1 | 8/2012 |
| DE | 10 2013 104 829 | A1 | 11/2014 |
| DE | 10 2013 104 830 | A1 | 11/2014 |
| DE | 102013104829 | * | 11/2014 |
| DE | 21 2013 000 112 | U1 | 12/2014 |
| DE | 10 2014 104 136 | A1 | 10/2015 |
| EP | 606564 | * | 7/1994 |
| EP | 695523 | * | 2/1996 |
| EP | 1 285 604 | B1 | 10/2005 |
| JP | 2004160224 | * | 6/2004 |
| WO | 2007118632 | * | 10/2007 |
| WO | 2009/149479 | A1 | 12/2009 |
| WO | 2010040273 | * | 4/2010 |
| WO | 2010129303 | * | 11/2010 |
| WO | 2011094776 | * | 8/2011 |
| WO | 2012092634 | * | 7/2012 |
| WO | 2014065523 | * | 5/2014 |
| WO | 2014/180899 | A1 | 11/2014 |
| WO | 2015/120493 | A1 | 8/2015 |

OTHER PUBLICATIONS

German Search Report in DE 10 2015 106 856.7 dated Mar. 8, 2016 with English translation of relevant parts.
International Search Report of PCT/EP2016/059887, dated Jul. 26, 2016.
German Search Report in DE 10 2015 106 873.7 dated Mar. 9, 2016 with English translation of relevant parts.
International Search Report in PCT/EP2016/059886, dated Jul. 26, 2016.
German Search Report in DE 10 2015 106 855.9 dated Mar. 8, 2016 with English translation of relevant parts.
International Search Report in PCT/EP2016/059890, dated Jul. 26, 2016.
German Search Report in DE 10 2015 106 852.4 dated Feb. 26, 2016 with English translation of relevant parts.
International Search Report in PCT/EP2016/059885, dated Jul. 26, 2016.
German Search Report in DE 10 2015 106 854.0 dated Feb. 29, 2016 with English translation of relevant parts.

* cited by examiner

Fig. 4A
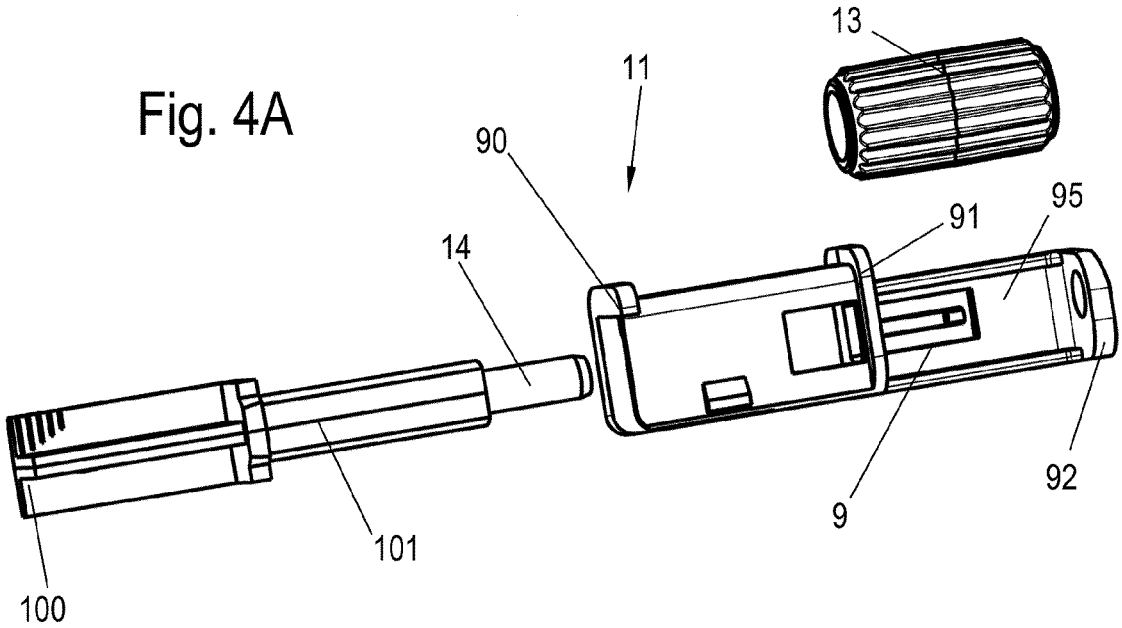
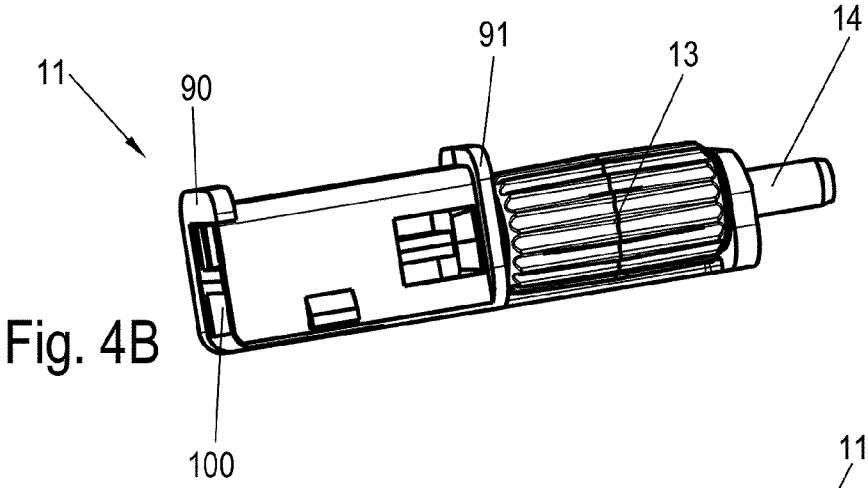
Fig. 4B
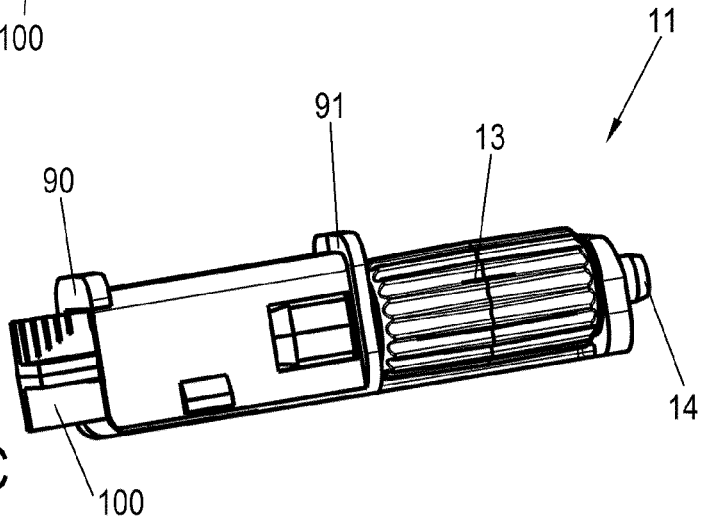
Fig. 4C

DEVICE AND METHOD FOR FIXING A PUSH ELEMENT

CROSS REFERENCE TO RELATED APPLICATIONS

This application is the National Stage of PCT/EP2016/059890 filed on May 3, 2016, which claims priority under 35 U.S.C. § 119 of German Application No. 10 2015 106 852.4 filed on May 4, 2015, the disclosures of which are incorporated by reference. The international application under PCT article 21(2) was not published in English.

BACKGROUND OF THE INVENTION

The present invention relates to a device for fixing a push element, in particular a drawer, to a rail of a pull-out guide, said device comprising a clamping mechanism with a receptacle for a holding part and a device for adjusting the depth for the push element, and a method for fixing a push element.

WO 2014/180899 discloses a pull-out guide in which a coupling element is arranged on a running rail and cooperates with a corresponding coupling element arranged on the furniture part in order to connect the furniture part to the running rail. At least one adjusting device for displacing the position of the coupling element relative to the running rail in at least one spatial direction is arranged on the running rail. The adjustment of the entire coupling part requires several mounting steps during the alignment of the drawer. In addition, the latching on the rail can only take place in several stages by means of spaced-apart latching elements.

EP 1 285 604 discloses a device for fixing a drawer to a rail of a pull-out guide, in which a base part which can be fastened to the drawer and a latching element which can be fixed to the pull-out guide are provided. In order to compensate for the distance between the guide rails of the pull-out guides, the latching element can be displaced within specific tolerances relative to the base part. The holding forces are limited by the design of the latching element and the base part as a plastic part, especially in the case of heavy drawers which extend in the pull-out direction up to the maximum pull-out position. In addition, it is desirable to position the drawer as precisely as possible within the furniture body in order to obtain an attractive joint pattern.

SUMMARY OF THE INVENTION

It is therefore an object of the present invention to provide a device and a method for fixing a push element, in which a simple alignment of the drawer with respect to the depth adjustment is made possible.

The device according to the invention for fixing a push element comprises a clamping mechanism with a receptacle, wherein the device for depth adjustment has a stop which can be adjusted on or in the receptacle. As a result, the entire receptacle no longer has to be moved for depth adjustment, but it is sufficient to limit the insertion depth of the holding part via the stop. As a result, the device for depth adjustment can be made compact. The term "depth adjustment" in the sense of the application means an adjustment in the longitudinal direction of the pull-out guide so that the drawer is adjusted in the installed position in the depth of the furniture body.

Preferably, the device for depth adjustment is infinitely variable. For this purpose, the device for depth adjustment can, for example, have a knurled nut rotatably mounted on a threaded bolt, a thread or an eccentric as a drive means.

In a further embodiment, a self-locking clamping element, in particular a self-locking clamping lever, is provided on the receptacle by means of which the holding part is frictionally secured against being pulled out. As a result, a particularly stable fixing of the push element can take place by means of the self-locking clamping lever, in particular also with regard to stop tests, in which the drawer is moved in the loaded state into the maximum opening position. The self-locking clamping lever of the clamping mechanism ensures that the holding part is held in such a way that it cannot be pulled out further from the receptacle in the opening direction. However, insertion of the holding part into the receptacle of the clamping mechanism is comparatively simple since only small frictional forces need to be overcome, so that assembly can be formed in a simple way. In addition, an infinitely variable fixing of the holding part can be achieved by a frictionally engaged connection of the clamping lever, which allows particularly precise positioning of the push element in the opening direction. Furthermore, the clamping lever is rotatably mounted about a pivot.

A frictionally engaged or force-locked connection differs from a form-fitting connection in that the holding forces are provided by frictional forces and not by form-fitting stop elements, such as teeth or stops. In this way, a stepless adjustment of the holding part can be obtained in the case of a force-locked fixing of the holding part, which is independent of stop elements.

For the frictionally engaged connection, the web-shaped holding part can have a substantially planar surface, which in certain areas is in contact with a contact surface on the clamping lever. The holding part can be strip-shaped, angled, U-shaped, produced as a hollow profile or with other geometries, in particular made of metal, wherein a section of a profile can be used for the frictionally engaged connection.

In this case, the clamping lever can be pretensioned into a locked position, in particular via one or more energy storage devices, so that unintended unlocking cannot take place.

According to a preferred embodiment of the invention, means for unlocking the clamping lever are provided, by means of which the force-locked connection of the clamping lever can be released from the holding part. A linearly movable slide or button can be provided for unlocking the clamping lever. In this case, the clamping lever can be designed as a two-armed lever, wherein a first arm, which rests with a contact surface against the holding part, and a second arm can be moved via the means for unlocking the clamping lever. By adjusting the length of the lever arms, appropriate force transmission ratios can be achieved, wherein the contact surface must be moved only slightly away from the holding part in order to unlock the clamping lever.

Preferably, the clamping lever rests on the holding part via a linear contact surface, which extends parallel to the pivot of the clamping lever. The contact surface can be edge-shaped, rounded or designed with a different contact surface to provide high clamping forces. In this clamping system, the high clamping forces are generated by a multiplication of forces by the lever effect.

Preferably, the holding part can be secured in a stepless manner to the clamping mechanism, so that the drawer is mounted on the pull-out guide during assembly and is pushed in slightly, and as soon as the holding part is fixed to the clamping mechanism, the fitter is given the certainty that the drawer is unable to inadvertently slip off the pull-out guide in the opening direction when it is pulled out. Rather, the clamping mechanism is activated as soon as the holding part is fixed on the clamping lever in the receptacle. Subsequent further insertion of the drawer for stepless adjustment is thus easily possible.

For a particularly stable fastening of the drawer, the holding part and the contact surface of the clamping lever resting on the holding part can be made of metal, for example of a steel sheet. In contrast to metal, plastic flows, so that only lower forces can be absorbed via the clamping mechanism, wherein the use of plastic materials, in particular reinforced plastics, is certainly possible.

Preferably, the pivot of the clamping lever is arranged in the insertion direction in front of a contact surface of the clamping lever on the holding part. As a result, self-locking is effected, wherein, in the mounted position, an angle between the contact surface of the clamping lever with respect to the pivot can be arranged at an angle to the longitudinal direction of the holding part between 55° and 89°, in particular 70° to 85°. Due to the angular position of the clamping lever, the freewheeling direction and the locking direction are defined in the clamping system. When the holding part is loaded in the locking direction, a self-reinforcing effect occurs, so that the clamping force also increases with rising loading of the holding part in the locking direction.

For easy assembly, the receptacle may be formed on a fastening part on which the clamping lever is rotatably mounted. Then the clamping lever can be pre-mounted with the receptacle as a unit on the rail or the drawer. Preferably, the fastening part is displaceably mounted on or in a housing. As a result, the fastening part can be moved relative to the housing via means for lateral adjustment, so that an exact alignment of the drawer is also possible in the horizontal direction perpendicular to the movement direction of the pull-out guide, wherein a height adjustment can also be provided.

Only a few mounting steps, which can be executed without the use of tools, are required for a mounting process for fixing a drawer. With a depth adjustment in conjunction with a clamping mechanism, it is possible to push the drawer into the body up to the level or depth of the adjacent panels. One can then pull out the drawer and turn the depth adjuster up to the clamping device to fix the panel position. The depth adjuster thus forms a stop for the clamping device, which prevents the drawer and/or the clamping device from being pushed further onto the holding part. Several attempts are saved in this type of adjustment possibility since the drawer is positioned in the installed position.

BRIEF DESCRIPTION OF THE DRAWINGS

The invention will be explained in closer detail below with reference to an exemplary embodiment with reference to the attached drawings, wherein:

FIGS. 4A-4C show several views of the device for depth adjustment;

DETAILED DESCRIPTION OF THE INVENTION

Figure 1:
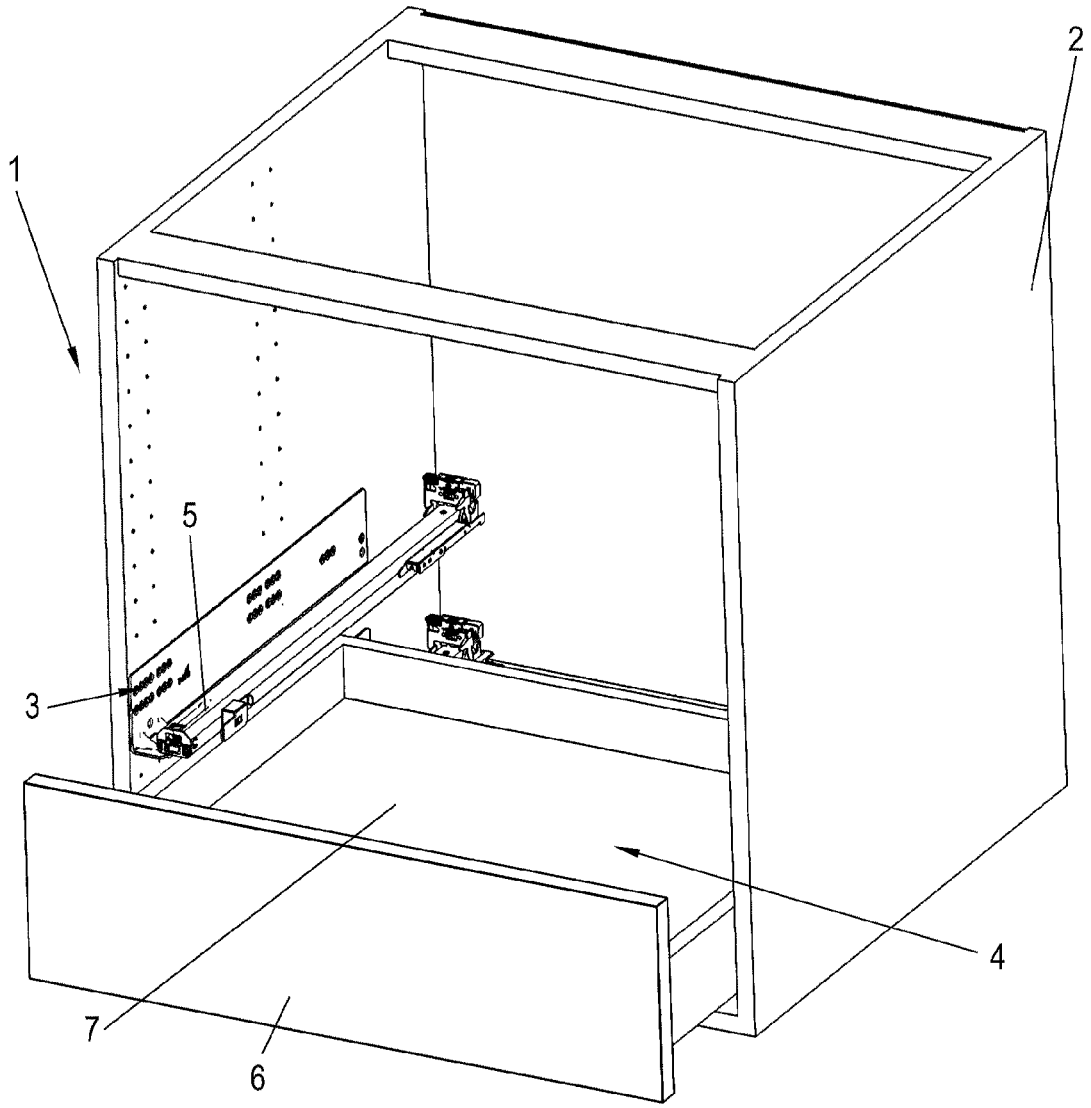
FIG. 1 shows a perspective view of a piece of furniture with a drawer.
Figure 2:
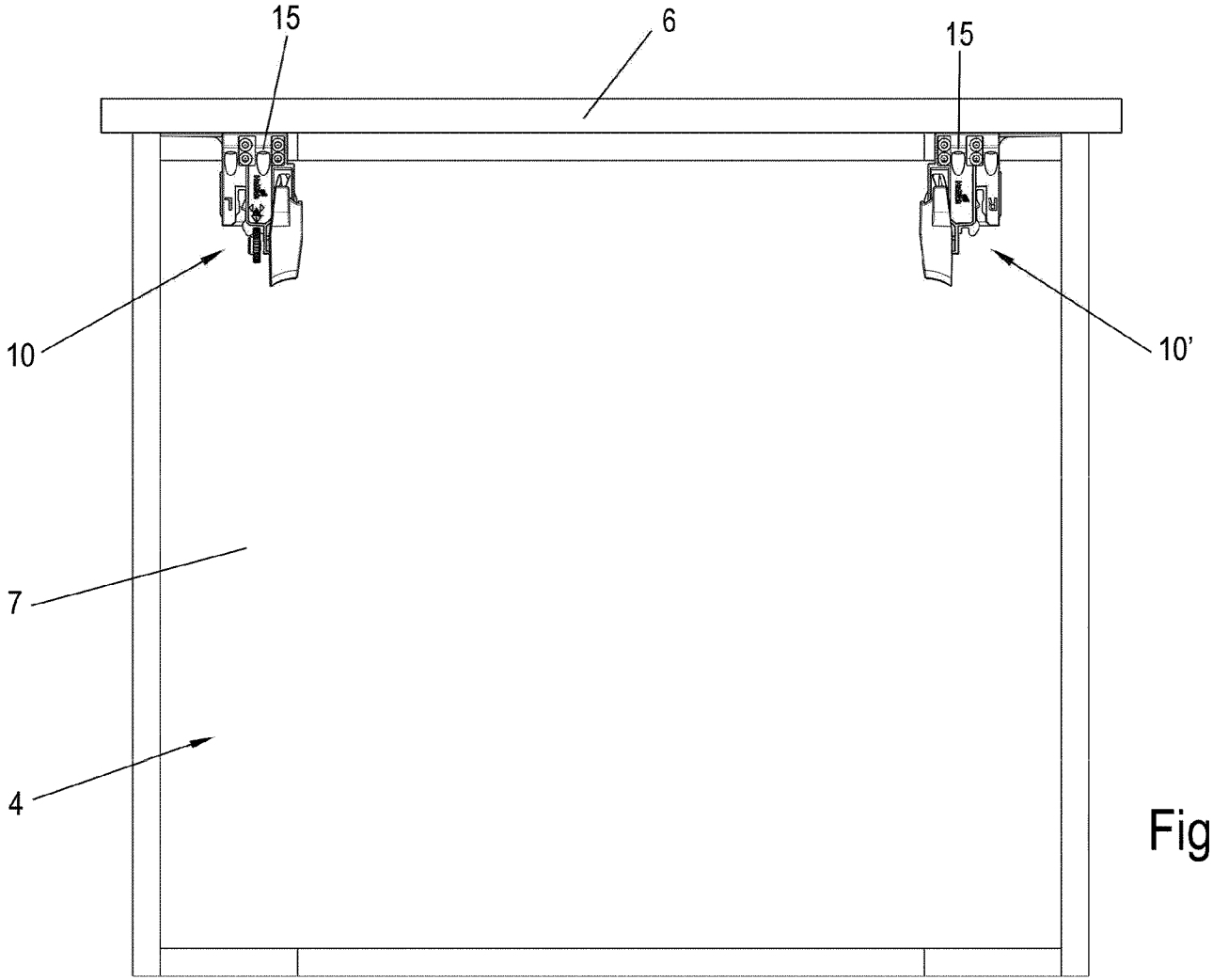
FIG. 2 shows a bottom view of the drawer of FIG. 1.

A piece of furniture 1 comprises a furniture body 2, on the side walls of which one or more pull-out guides 3 are fixed, which each have at least one movable rail 5. A drawer 4 is held displaceably on two such rails 5, wherein a device 10 or 10' is provided on each rail 5 for fixing the drawer 4 to the rail 5, as can be seen from the bottom view of FIG. 2. A first device 10 with lateral adjustment for fixing the drawer 4 and a second device 10' without lateral adjustment for fixing the drawer 4 to a rail 5 are fixed to a bottom 7 of the drawer 4. Each device 10 and 10' comprises a housing 15, which is fixed to a front panel 6 and/or to the bottom 7 of the drawer 4.

Figure 3A:
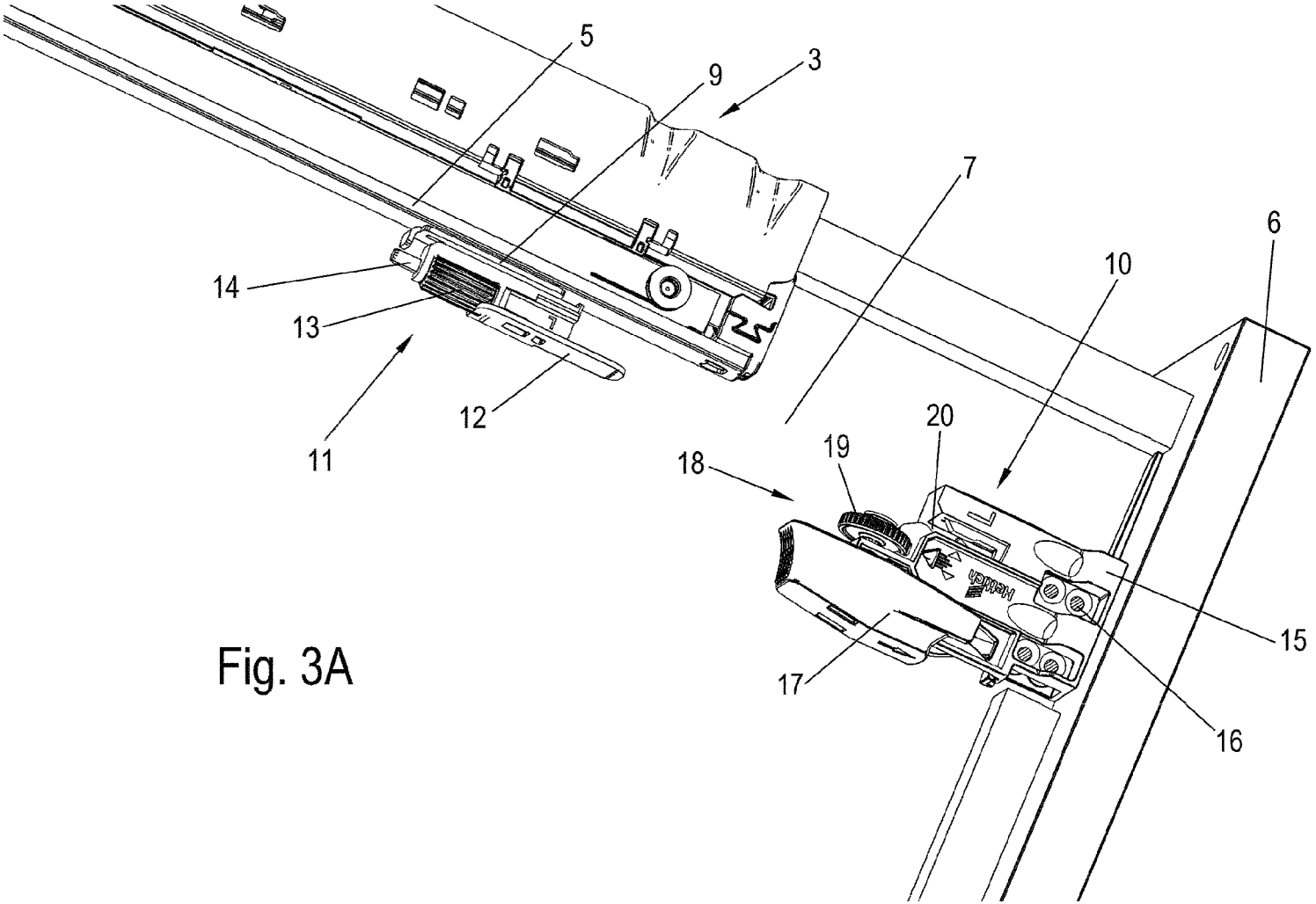
FIG. 3A shows a perspective detailed view of the device according to the invention for fixing the drawer.

In the detailed view of FIG. 3A, the device 10 is shown during assembly. The housing 15 can be fixed on the underside of the drawer 4 via fastening means 16, wherein a receptacle 20 is provided for inserting a holding part 12. The holding part 12 is attached to the rail 5 of the pull-out guide 3. In this case, the web-shaped holding part 12 can selectively be fixed to the rail 5 by means of an integrally formed tab 9, e.g. by welding, or by means of further components, or the holding part 12 is a part of the rail profile of the rail 5. A device 11 for depth adjustment is provided on the tab 9, which has a non-rotational threaded bolt 14 on which a knurled nut 13 is rotatably supported but is non-displaceable in the axial direction. As a result, by rotating the knurled nut 13, the threaded bolt can be moved in the longitudinal direction of the rail 5 and thus move a stop which predetermines the insertion depth of the holding part 12 in the receptacle 20. Optionally, such a device 11 for depth adjustment can also be dispensed with.

For assembly, the drawer 4 is placed on the two rails 5 of the two pull-out guides 3 and pushed into the closed position. In this case, a respective web-shaped holding part 12 is inserted at opposite sides into the receptacle 20 of the device 10 or 10' and fixed via a clamping mechanism that secures the holding part 12 by clamping and frictional engagement against being pulled out.

Figure 3B:
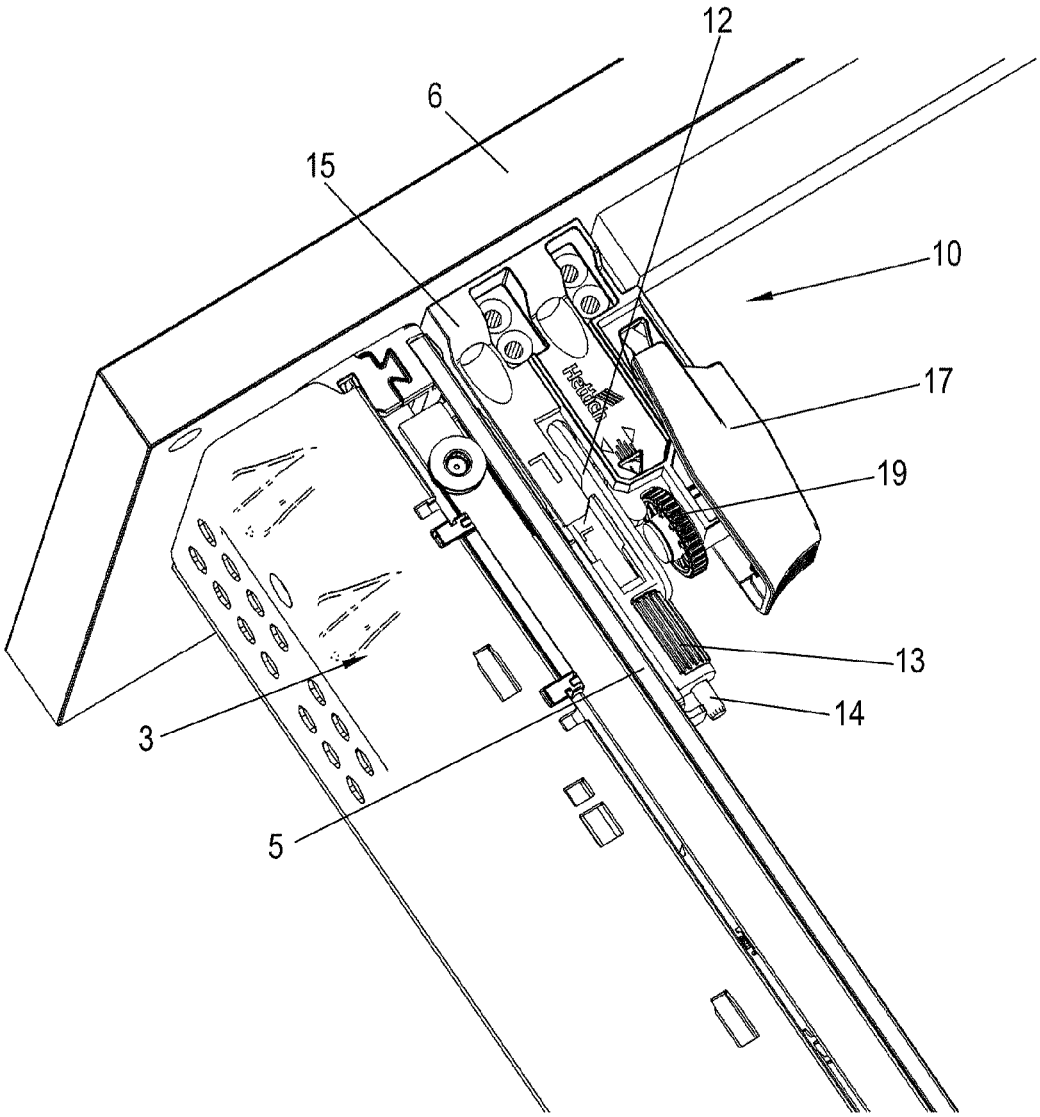
FIG. 3B shows perspective view of the device of FIG. 3A in the assembled position.

FIG. 3B shows the mounted position of the drawer 4. The holding part 12 has been inserted into the receptacle 20 and secured there against being pulled out. The lateral joint pattern can now be adjusted via a device 18 for lateral adjustment. The device 18 for lateral adjustment comprises a knurled nut 19 which, by rotating, causes the housing 15 to be moved laterally in the horizontal direction relative to the receptacle 20 to perform lateral adjustment.

In FIGS. 4A to 4C, the device for depth adjustment is shown in detail. Two angled webs 91 and 92 are provided on a carrier 95, between which the knurled nut 13 is rotatably mounted but axially in a non-displaceable manner. The knurled nut 13 is mounted in this case on a threaded bolt 101, on which a pin 14, which is passed through an opening in the web 92, is provided on one side, and a stop 100 is provided on the other side. The block-shaped stop 100 is guided at a distance from the web 91 by a guide element 90. By rotating the knurled nut 13, the stop 100 can be displaced for depth adjustment in the longitudinal direction of the pull-out guide 3, as can be seen from the different positions of FIGS. 4B and 4C.

Figure 5:
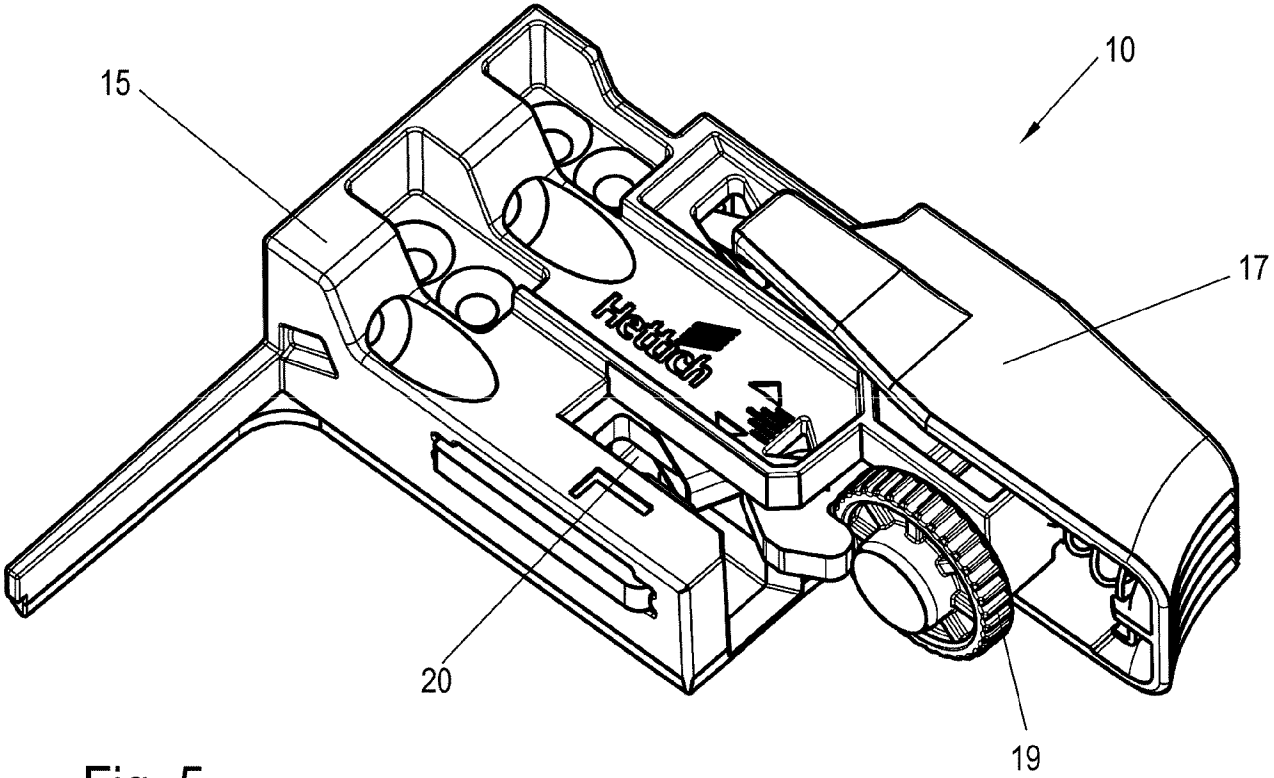
FIG. 5 shows a perspective view of the device without a drawer before assembly.

FIG. 5 shows the device 10 without the holding part 12. The device 10 comprises a slide 17 which serves to unlock the clamping mechanism. As a result, the drawer 4 can be dismantled again after the assembly when the slide 17 is actuated.

Figure 6:
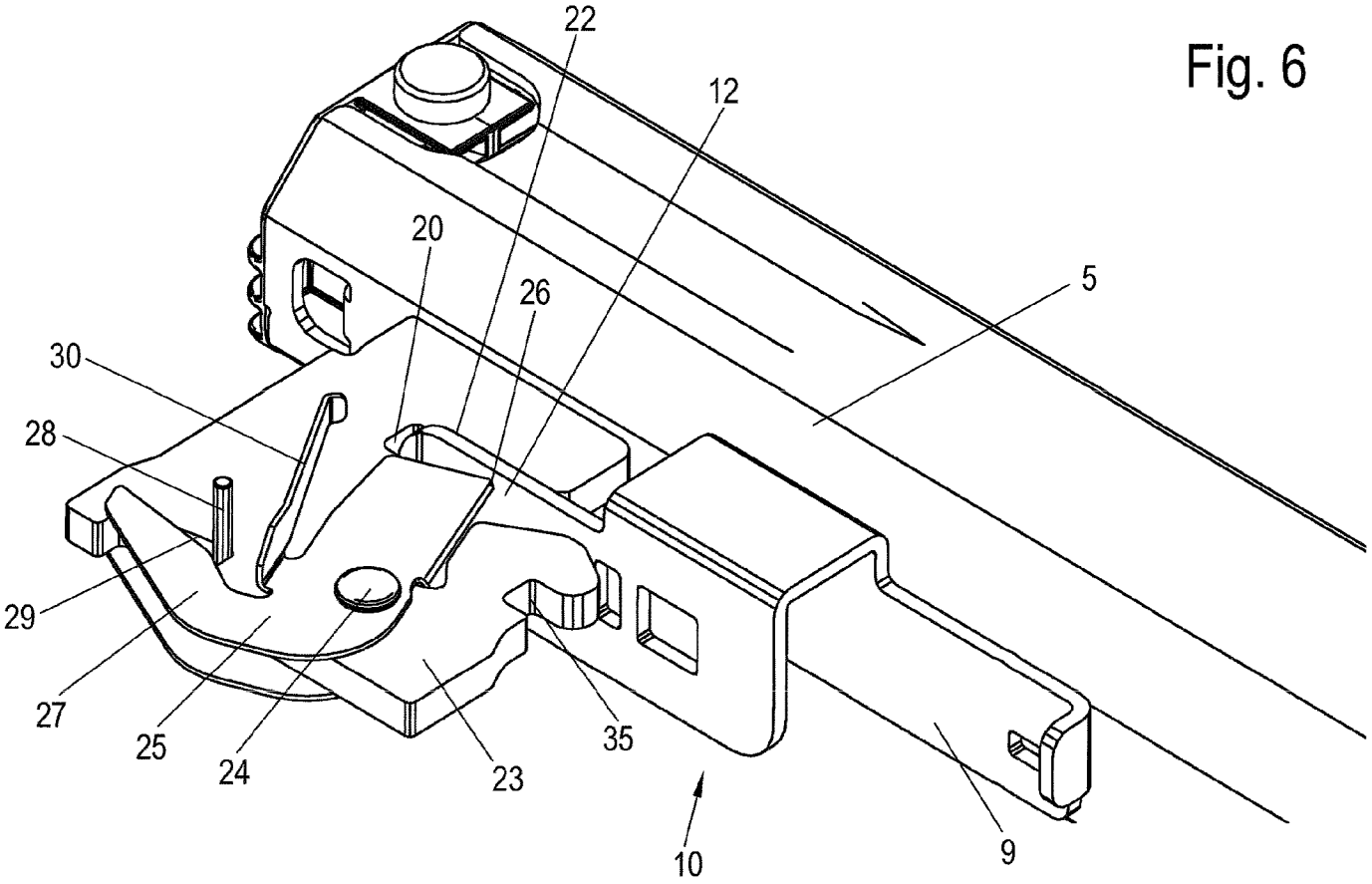
FIG. 6 shows perspective view of the device without housing during assembly.

FIG. 6 shows the device 10 without the housing 15, but with the holding part 12, which is clamped in the receptacle 20 in a clamping manner.

The clamping mechanism comprises a clamping lever 25, which is rotatably mounted on a fastening part 23 about a pivot 24. The fastening part 23 is of plate-shaped design and forms a side wall 22 of the receptacle 20, which is arranged opposite the clamping lever 25. The holding part 12 is fixed by clamping in a frictional manner between a contact surface 26 of the clamping lever 25 and the side wall 22 and secured against being pulled out. For this purpose, the pivot 24 is arranged in front of the contact surface 26, as seen in the direction of insertion of the holding part 12, so that the holding part 12, when being inserted into the receptacle 20, first passes a plane perpendicular to the insertion direction which is arranged in the pivot 24, before the holding part 12 touches the contact surface 26. As a result, the clamping lever 25 is formed in a self-locking manner and acts on the holding part 12 in the case of tensile forces, with the clamping lever 25 being pressed with the contact surface 26 even more strongly against the holding part 12.

The clamping lever 25 is designed as a two-armed lever, wherein the contact surface 26 is formed on one arm for the clamping fixing of the holding part 12, and means for unlocking the clamping lever 25 act on a second arm 27. The clamping lever 25 is designed in the form of an angle and is pretensioned into the clamping position by an integrally formed spring 30. In this case, the spring 30 is designed as a leaf spring and rests on the housing 15. The means for unlocking comprise a bolt 28, which is slidably formed in a wedge-shaped gap 29 between the arm 27 and the fastening part 23. When the bolt 28 is moved along fastening part 23 to the end of the arm 27, the arm 27 is moved by the wedge-shaped formation of the gap 29, and the clamping lever 25 rotates so that the contact surface 26 is disengaged from the holding part 12. As a result, the holding part 12 can be easily pulled out after the clamping lever 25 has been turned. The bolt 28 is guided along a side wall of the fastening part 23.

The clamping lever 25 is in this case made from a bent metal plate which engages around a portion of the plate-shaped fastening part 23 in a U-shaped manner. The bottom of the U is formed in this case on the contact surface so that a line-shaped contact surface 26 rests against the holding part.

Figure 7:
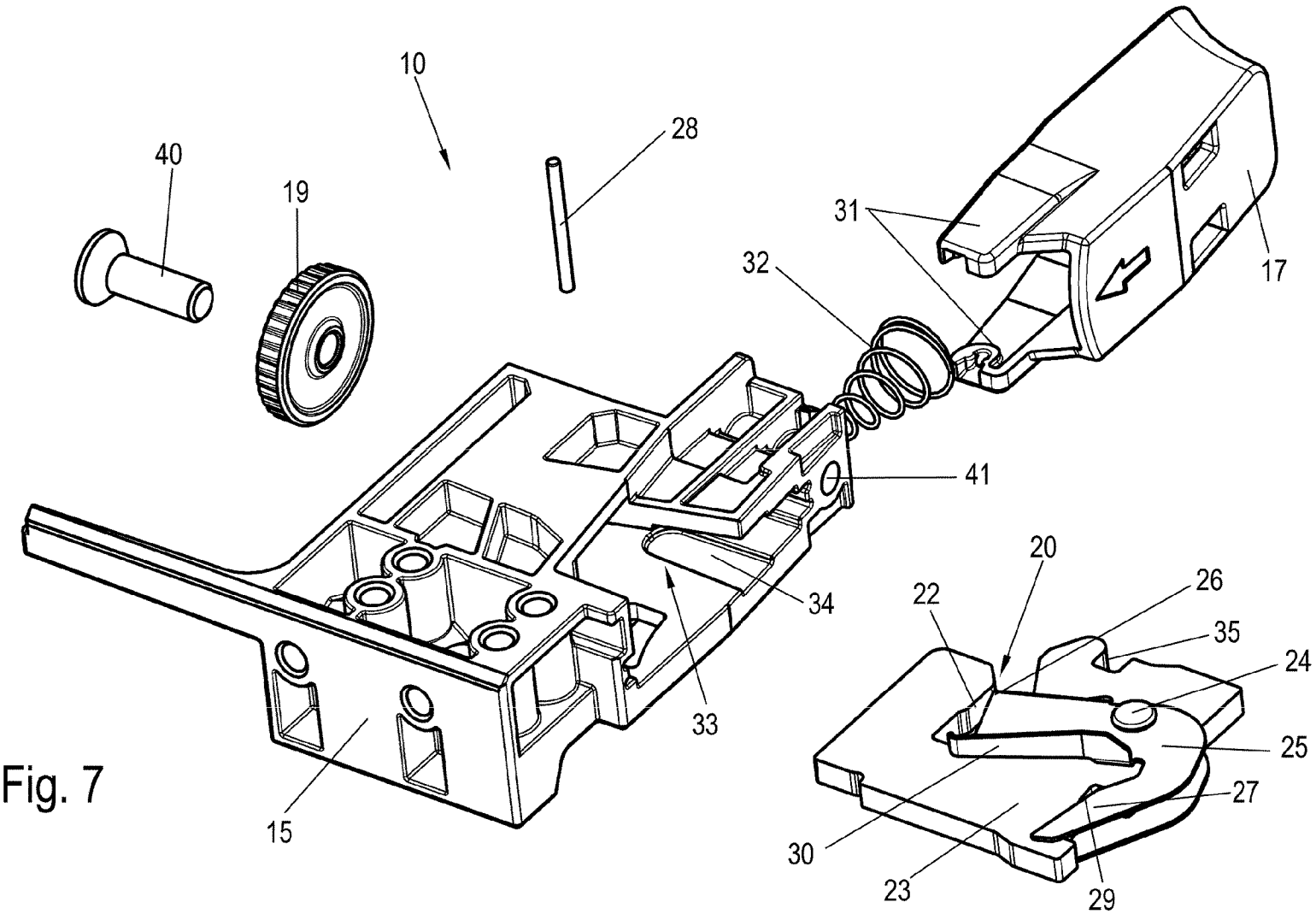
FIGS. 7 to 9 show several views of the device for fixing a drawer without holding part.

FIG. 7 shows an exploded view of the device 10 with the housing 15. A slot-shaped receptacle 33 is provided on the housing 15, on which the fastening part 23 is held displaceably with the clamping lever 25. In this case, a head section on the pivot 24 is guided in a groove-shaped guide 34. The fastening part 23 can be guided in the housing 15 via further or other surfaces. Furthermore, the slide 17 is shown, which is designed as a cap-shaped part and holds the bolt 18 between two arms 31. The bolt 28 can be displaced along the wedge-shaped gap 29 by means of a movement of the slide 17. The slide 17 is pretensioned in this case by a spring 32 into an initial position, in which the bolt 28 does not unlock the clamping lever 25. Only by shifting the slide 17 against the force of the spring 32 unlocking of the clamping lever 25 is effected.

Furthermore, the device 18 for lateral adjustment is shown, in which a threaded bolt 40 engages in a threaded bore 41. A knurled nut 19 is fixed on the threaded bolt 40, wherein one edge of the knurled nut engages in a U-shaped receptacle 35 on the fastening part 23. By rotating the knurled nut 19, the fastening part 23 can thus be displaced relative to the housing 15 in the longitudinal direction of the threaded bolt 40, i.e. in a plane parallel to the front panel 6 of the drawer 4.

Figure 8B:
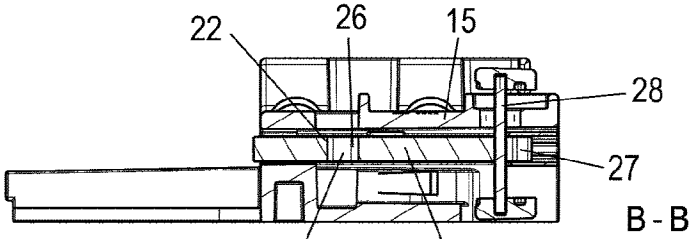
Figure 8C:
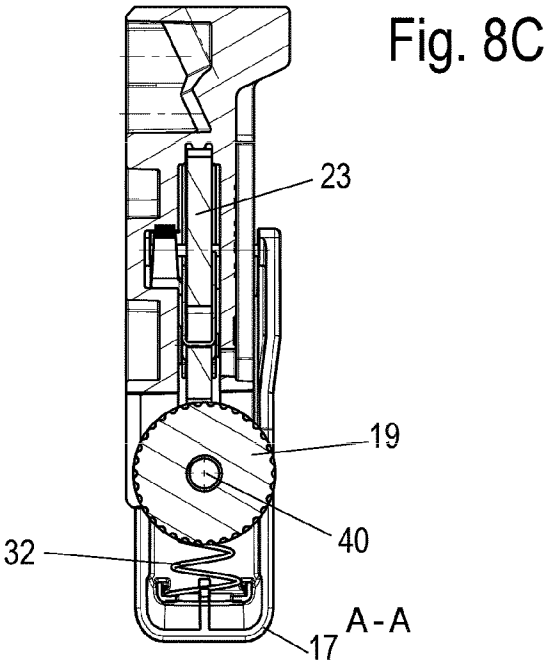
Figure 8A:
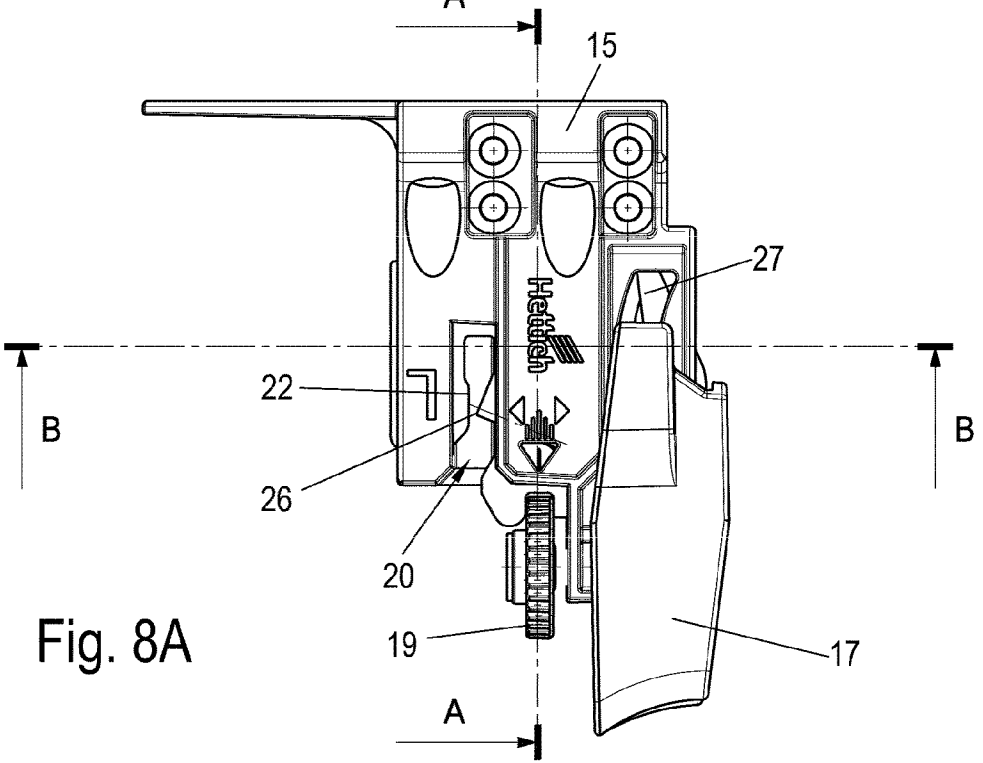

FIGS. 8A to 8C show the device 10 with the housing 15 in detail. The plate-shaped fastening part 23 is slidably mounted within the receptacle 33 of the housing 15 and in turn itself supports the clamping lever 25 via the pivot 24. The slide 17 engages around the housing 15 in a U-shaped manner and is guided linearly in order to pivot the clamping lever 25 for an unlocking operation by displacement.

Figure 9:
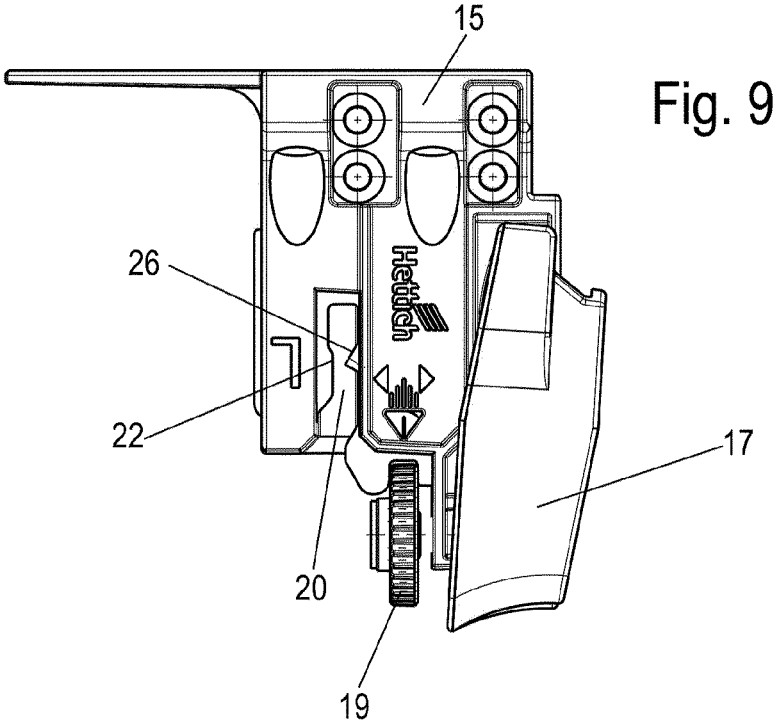

In FIG. 9, the device 10 is shown in an unlocking position, in which the slide 17 has been pushed onto the housing 15. The bolt 28 thus moves the clamping lever 25 so that the contact surface 26 moves slightly away from the opposing side wall 22 so that a holding part 12, which is arranged between the side wall 22 and the contact surface 26, can be pulled out of the receptacle 20. The movement of the contact surface 26 can be in a range between 0.02 to 4 mm, in particular 0.4 mm to 2 mm.

Figure 10:
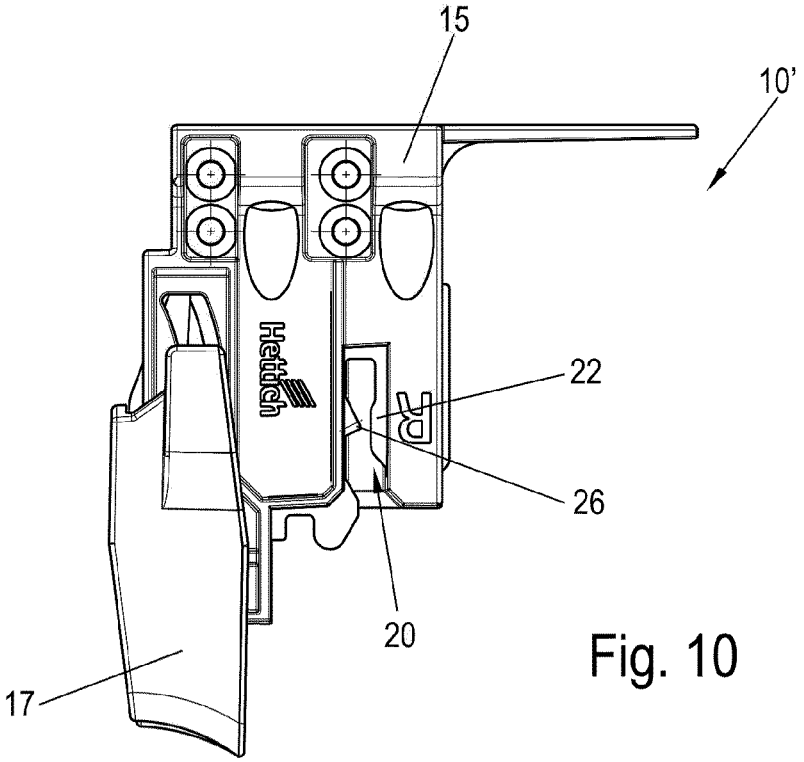
FIG. 10 shows a view of a modified device for fixing a drawer without lateral adjustment.

FIG. 10 shows the device 10', which is designed like the device 10, but without the device 18 for lateral adjustment. In this respect, the knurled nut 19 and the threaded bolt 40 are missing. Apart from that, the device 10' can be designed identically or mirror-symmetrically to the device 10. In this case, the fastening part 23 can be movably mounted in the housing 15, so that the device 10' forms a loose bearing, whereas on the opposite side a fixed bearing is provided which positions the drawer 4 within the furniture body 2 in the horizontal lateral direction.

In the exemplary embodiment shown, both the clamping lever 25 and the fastening part 23 consist of metal, in particular of a steel sheet. As a result, particularly high holding forces can be applied to the likewise metallic holding part 12.

In the exemplary embodiment shown, the clamping lever 25 is mounted with two arms around a pivot 24. It is also possible to form the clamping lever 25 with only one arm. Furthermore, other means for unlocking the clamping lever 25 can also be provided instead of the slide 17, for example a pivotable unlocking lever.

It is understood that the clamping lever 25 is merely representative of an example for a clamping element. Another clamping element, e.g. a clamping shoe or a clamping roller, is also possible for the use according to the invention.

LIST OF REFERENCE NUMERALS

1 A piece of furniture
2 Furniture body
3 Pull-out guide
4 Drawer
5 Rail
6 Front panel
7 Bottom
9 Tab
10, 10' Device
11 Device for depth adjustment

12 Holding part
13 Knurled nut
14 Pin
15 Housing
16 Fastening means
17 Slide
18 Device
19 Knurled nut
20 Receptacle
22 Side wall
23 Fastening part
24 Pivot
25 Clamping lever
26 Contact surface
27 Arm
28 Bolt
29 Gap
30 Spring
31 Arm
32 Spring
33 Receptacle
34 Guide
35 Receptacle
40 Threaded bolt
41 Threaded bore
90 Guide element
91, 92 Web
95 Carrier
100 Stop
101 Threaded bolt

What is claimed is:

1. A device for fixing a push element to a rail (5) of a pull-out guide (3), comprising:

a clamping mechanism with a receptacle (20);

a holding part (12) securable in the receptacle, a device for depth adjustment for the push element (4), and a self-locking clamping element (25) provided on the receptacle (20), by means of which the holding part (12) is frictionally secured against being pulled out, wherein the device (11) for depth adjustment has a stop (100) which can be adjusted on or in the receptacle (20).

2. The device according to claim 1, wherein the device (11) is variable for depth adjustment.

3. The device according to claim 2, wherein the device for depth adjustment has a thread or an eccentric as a drive.

4. The device according to claim 1, wherein the clamping element is a clamping lever (25).

5. The device according to claim 4, wherein the clamping lever (25) is pretensioned into the locked position.

6. The device according to claim 4, wherein a device (28) for unlocking the clamping lever (25) is provided, by means of which the connection of the clamping lever (25) can be released from the holding part (12).

7. The device according to claim 4, wherein the clamping lever (25) is designed as a two-armed lever, and a first arm rests with a contact surface (26) against the holding part (12) and the second arm is movable via a device (28) for unlocking the clamping lever (25).

8. The device according to claim 4, wherein the clamping lever (25) rests via a linear contact surface (26) against the holding part (12) which extends parallel to a pivot (24) of the clamping lever (25).

9. The device according to claim 4, wherein the surface of the clamping lever (23), which rests against the holding part (12), and the holding part (12) are made of metal.

10. The device according to claim 4, wherein a pivot (24) of the clamping lever (25) is arranged on the holding part (12) in the insertion direction in front of a contact surface (26) of the clamping lever (25).

11. The device according to claim 4, wherein the receptacle (20) is formed on a fastening part (23) on which the clamping lever (25) is rotatably mounted.

12. The device according to claim 11, wherein the fastening part (23) is displaceably mounted on or in a housing (15).

13. The device according to claim 1, wherein at least one adjusting device is provided which is configured for adjusting a push element (4) laterally or in height relative to a pull-out guide (3).

14. The device according to claim 1 wherein the stop (100) limits the insertion depth of the clamping mechanism.

15. The device according to claim 1, wherein the device for depth adjustment is configured to adjust a relative position of a push element to a pull-out guide.

16. A piece of furniture (1), comprising a furniture body (2) and at least one drawer (4) which is movably held on the furniture body (2) via two pull-out guides (3), and at least one pull-out guide (3) is connected to the drawer (4) via the device according to claim 1.

17. A device for fixing a push element (4) to a rail (5) of a pull-out guide (3), comprising:

a clamping mechanism with a receptacle (20) for a holding part (12), and a device for depth adjustment for the push element (4), wherein the device (11) for depth adjustment has a stop (100) which can be adjusted on or in the receptacle (20) and wherein the stop (100) of the device for depth adjustment limits the insertion depth of the clamping mechanism.

* * * * *